US008339349B2

(12) United States Patent
Shin et al.

(10) Patent No.: US 8,339,349 B2
(45) Date of Patent: Dec. 25, 2012

(54) GATE DRIVING UNIT FOR LIQUID CRYSTAL DISPLAY DEVICE AND METHOD OF REPAIRING THE SAME

(75) Inventors: Hong-Jae Shin, Seoul (KR); Jeom-Jae Kim, Gyeonggi (KR); Mike (J. S.) Lee, Seoul (KR)

(73) Assignee: LG Display Co., Ltd., Seoul (KR)

( * ) Notice: Subject to any disclaimer, the term of this patent is extended or adjusted under 35 U.S.C. 154(b) by 921 days.

(21) Appl. No.: 12/318,272

(22) Filed: Dec. 23, 2008

(65) Prior Publication Data

US 2010/0001941 A1 Jan. 7, 2010

(30) Foreign Application Priority Data

Jul. 7, 2008 (KR) ..... 10-2008-0065283

(51) Int. Cl.
*G09G 3/36* (2006.01)

(52) U.S. Cl. ..... 345/98

(58) Field of Classification Search ..... 377/78; 345/93, 98

See application file for complete search history.

(56) References Cited

U.S. PATENT DOCUMENTS 5,250,931 A * 10/1993 Misawa et al. ..... 345/206
5,926,156 A * 7/1999 Katoh et al. ..... 345/55
2006/0256066 A1* 11/2006 Moon ..... 345/100

FOREIGN PATENT DOCUMENTS

JP 09-015557 A 1/1997
KR 10-2005-0079718 8/2005

OTHER PUBLICATIONS

Japanese Office Action mailed Nov. 16, 2011 from counterpart Japanese patent application (with translation).

* cited by examiner

*Primary Examiner* — Alexander S Beck
*Assistant Examiner* — Joseph Pena
(74) *Attorney, Agent, or Firm* — Morgan, Lewis & Bockius LLP

(57) ABSTRACT

A gate driving unit for a liquid crystal display device including a plurality of liquid crystal pixels, first to Nth gate lines, a plurality of liquid crystal capacitors and a plurality of thin film transistors, includes first and second clock signal lines for providing first and second clock signals; first to Nth shift registers respectively corresponding to the first to Nth gate lines, the first to Nth shift registers receiving one of the first clock signal and the second clock signal and outputting first to Nth scanning signals, respectively; a redundant repair shift register as (N+1)th shift register receiving one of first and second clock signals and outputting a repair scanning signal; a plurality of first switches for respectively connecting one of the first and second clock signal lines to the first to Nth shift registers and the redundant repair shift register; a plurality of second switches for respectively switching a connection of the first to Nth shift registers with the first to Nth gate lines; and a plurality of third switches for respectively switching a connection of the second to Nth shift registers and the redundant repair shift register with the first to Nth gate lines, wherein N is positive integer.

10 Claims, 9 Drawing Sheets

GATE DRIVING UNIT FOR LIQUID CRYSTAL DISPLAY DEVICE AND METHOD OF REPAIRING THE SAME

This application claims the benefit of Korean Patent Application No. 10-2008-0065283, filed on Jul. 7, 2008, which is hereby incorporated by reference in its entirety.

TECHNICAL FIELD

The present application relates to a liquid crystal display (LCD) device and a method of driving the liquid crystal display device. Specifically, a gate driving unit of a liquid crystal display device that may include a redundant repair shift register and a method of repairing the gate driving unit.

BACKGROUND

Display devices have become thinner and larger as industrial utilization has increased. Among the various types of flat panel display (FPD) devices, liquid crystal display (LCD) devices and plasma display panel (PDP) devices are widely used. LCD devices are widely used as monitors for notebook computers and desktop computers because of characteristics such as light weight, portability and low power consumption. Specifically, active matrix type LCD devices having thin film transistors (TFTs) as switching elements have been researched and developed due to the quality of the display of moving images.

The LCD device uses optical anisotropy and polarization properties of liquid crystal molecules to display images. The liquid crystal molecules have orientation characteristics of arrangement resulting from their thin and long shape. Thus, an arrangement direction of the liquid crystal molecules can be controlled by applying an electrical field to them. Particularly, the LCD device including a thin film transistor (TFT) as a switching element, referred to as an active matrix LCD (AM-LCD) device, has excellent characteristics of high resolution and displaying moving images. Since the LCD device includes the TFT as the switching element, it may be referred to a TFT-LCD device.

FIG. 1 is a schematic block diagram of a liquid crystal display device according to the related art. In FIG. 1, the liquid crystal display device includes a liquid crystal panel 2 and a liquid crystal module (LCM) driving circuit unit 26. The LCM driving circuit unit 26 includes an interface 10, a timing controller 12, a source voltage generator 14, a reference voltage generator 16, a data driver 18 and a gate driver 20. The data driver 18 may also be referred to as a source driver, which may be distinguished from the source voltage generator 14. The gate driver 20 may be referred to as a gate driving unit. The interface 10 as a driving system, for example, a personal computer, receives data, for example (R), red (G), green (B) and blue data, and control signals, for example, input clocks, a horizontal sync signals, vertical sync signals and data enable signals, inputted into the LCD driving circuit unit 26 from a driving system, for example, a personal computer. Then, the interface 10 outputs the RGB data and control signals to the timing controller 12. For example, a low voltage differential signal (LVDS) interface and transistor-transistor logic (TTL) interface may be used for transmission of the RGB data and the control signals. In addition, the interface 10 may be integrated on a single chip together with the timing controller 12.

Referring to FIG. 2 showing a liquid crystal panel of the liquid crystal display device according to the related art, a plurality of gate lines "GL1" to "GLn" and a plurality of data lines "DL1" to "DLm" are formed on a glass substrate to define a plurality of pixel regions. Each of a thin film transistor (TFT) and a liquid crystal ($C_{LC}$) is formed in each pixel region such that the liquid crystal display device can display an image.

Referring back to FIG. 1, the timing controller 12 generates data control signals for the source driver 18 including a plurality of data integrated circuits (ICs), and gate control signals for the gate driving unit 20 including a plurality of gate ICs. In addition, the timing controller 12 outputs data signals from the interface 10 to the source driver 18.

The reference voltage generator 16 generates reference voltages of a digital-to-analog converter (DAC) used in the source driver 18. The reference voltages are set up according to transmittance-voltage characteristics of the liquid crystal panel 2.

The source driver 18 determines the reference voltages for the data signals according to the control signals from the timing controller 12 and outputs the determined reference voltages to the liquid crystal panel 2 to adjust a rotation angle of liquid crystal molecules.

The gate driving unit 20 controls ON/OFF operation of the thin film transistors (TFTs) in the liquid crystal panel 2 according to the control signals from the timing controller 12. The gate driving unit 20 enable supplies scanning signals to the gate lines GL1 to GLn of the liquid crystal panel 2. Accordingly, the data signals from the source driver 18 are supplied to pixels in the pixel regions of the liquid crystal panel 2 through the TFTs. The source voltage generator 14 supplies source voltages to elements of the LCD device and a common voltage to the liquid crystal panel 2.

Although not shown in FIGS. 1 and 2, a backlight unit including at least one lamp is disposed under the liquid crystal panel 2 to supply a light to the liquid crystal panel 2.

FIG. 3 shows a gate driving unit accordingly to the related art. In FIG. 3, each of first to nth shift registers SR1 to SRn supplies an output, for example, first to nth gate voltages Vg1 to Vgn, according to one of the clock signals CLK1 and CLK2. The clock signals CLK1 and CLK2 are input into a clock signal terminal CLK. For example, an output of the nth shift register SRn is input into a start signal terminal STR for being used for a start signal Vst of previous shift register. The output of the nth shift register SRn is input into a reset signal terminal RST for being used for a reset signal of next shift register. As a result, the gate driving unit 20 outputs sequential timing scanning signals Vg1 to Vgn, as shown in FIG. 4 showing a signal timing chart of a scanning signal from a gate driving unit according to the related art.

Although not shown, each of the shift registers SR1 to SRn receives a high level driving voltage VDD and a low level driving voltage VSS for driving thereof. In addition, the last nth shift register SRn receives a reset signal Vrst through a separating way. The gate driving unit 20 includes a redundant repair shift register SR(r) and a plurality of repair lines RL for repairing disordered shift registers of the first to nth shift registers SR1 to SRn. With the redundant repair shift register SR(r) and the plurality of repair lines RL, when at least one shift registers of the first to nth shift registers SR1 to SRn is broken down, the redundant repair shift register SR(r) functions as the disordered shift register, as shown in FIG. 5 showing a repairing method of the gate driving unit according to the related art.

In FIG. 5, when the second shift register SR2 is broken down, input and output lines of the second shift register SR2 is disconnected by a laser. Then, a line of the redundant repair shift register SR(r) is connected to the repair line RL by a laser welding such that the redundant repair shift register SR(r) is used for outputting the second scanning signal V2 instead of the second shift register SR2.

Unfortunately, the above-mentioned repairing method using the redundant repair shift register has some problems. Referring to FIG. 6, the fairer a distance between the repair shift register and the disordered shift register is, the greater load there is on the input and output lines. Accordingly, there is a signal distorting in the output signal. This problem is outstanding in case that the shift registers SR1 to SRn and the TFTs are formed at edges of the substrate at the same time. This is referred to as a gate in panel (GIP) type.

SUMMARY

Accordingly, embodiments of the invention are directed to a gate driving unit for a liquid crystal display device that substantially obviates one or more of the problems due to limitations and disadvantages of the related art.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the invention, as embodied and broadly described, a gate driving unit for a liquid crystal display device including a plurality of liquid crystal pixels, first to Nth gate lines, a plurality of liquid crystal capacitors and a plurality of thin film transistors, includes first and second clock signal lines for providing first and second clock signals; first to Nth shift registers respectively corresponding to the first to Nth gate lines, the first to Nth shift registers receiving one of the first clock signal and the second clock signal and outputting first to Nth scanning signals, respectively; a redundant repair shift register as (N+1)th shift register receiving one of first and second clock signals and outputting a repair scanning signal; a plurality of first switches for respectively connecting one of the first and second clock signal lines to the first to Nth shift registers and the redundant repair shift register; a plurality of second switches for respectively switching a connection of the first to Nth shift registers with the first to Nth gate lines; and a plurality of third switches for respectively switching a connection of the second to Nth shift registers and the redundant repair shift register with the first to Nth gate lines, wherein N is positive integer.

In another aspect, a method of repairing a gate driver including first to second clock signal lines for respectively providing first and second clock signals, first to Nth shift registers for respectively providing first to Nth scanning signals into first to Nth gate lines, an (N+1)th shift register as a redundant shift register for repairing an disordered shift register and providing a redundant repair signal into a redundant repair gate line, first switches for respectively connecting one of the first and second clock signal lines with clock signal terminals of the first to (N+1)th shift registers, second switches for respectively connecting output lines of the first to Nth shift registers with the first to Nth gate lines, third switches for respectively connecting the output lines of the second to (N+1)th shift registers with the first to Nth gate lines, a start signal line connecting a start signal terminal of the second to (N+1)th shift registers with the output line of the first to Nth shift registers, and a reset signal line connecting a reset signal terminal of the first to Nth shift registers with the output line of the second to (N+1)th shift registers includes detecting an disorder of an Mth shift register; switching off the first switch of the Mth shift register to block an input clock signal into the Mth shift register; disconnecting the start signal line and the reset signal line of the Mth shift register; switching off the second switch of each of the Mth to Nth shift registers to block output signals from the Mth to Nth shift registers into the Mth to Nth gate lines; switching the first switch of each of (M+1)th to (N+1)th shift registers to change the first clock signal applied into corresponding shift registers into the second clock signal and the second clock signal applied into corresponding shift registers into the first clock signal; and switching on the third switch of each of Mth to Nth shift registers to provide output signals of the (M+1)th to (N+1)th shift registers into Mth to Nth gate lines, respectively, wherein each of N and M is positive integer, and M is greater than 1, and wherein M is equal to or smaller than N.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principle of the invention. In the drawings.

DETAILED DESCRIPTION OF THE EMBODIMENTS

Reference will now be made in detail to the preferred embodiments, examples of which are illustrated in the accompanying drawings.

Figure 1:
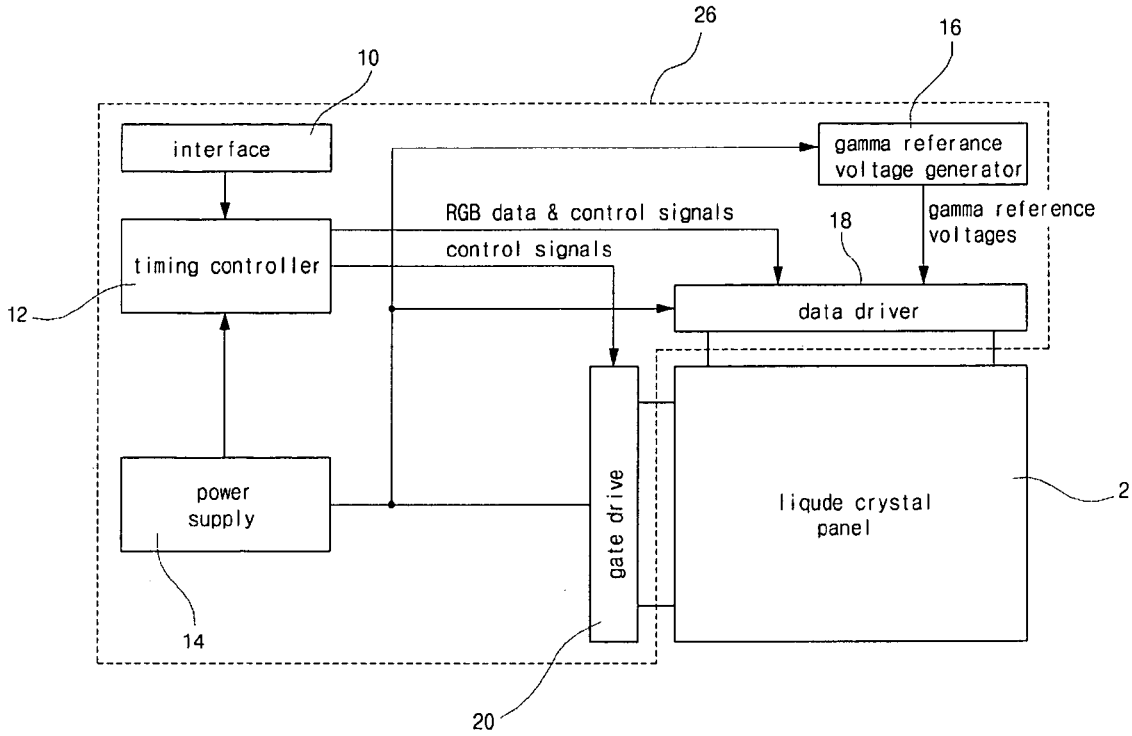
(related art) FIG. 1
FIG. 1 is a schematic block diagram of a liquid crystal display device according to the related art.
Figure 2:
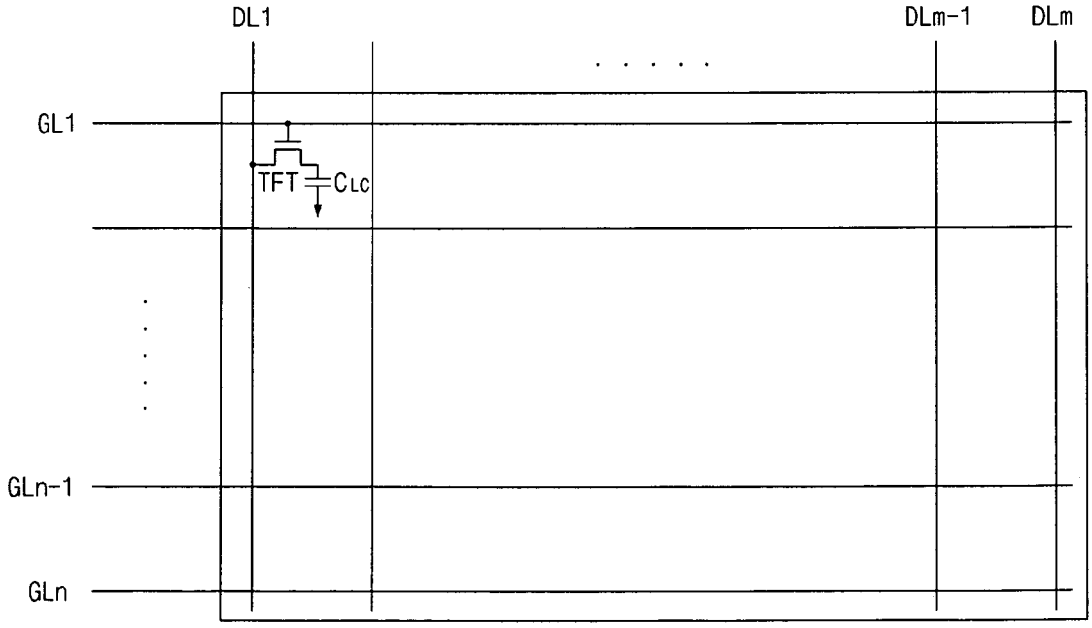
(related art) FIG. 2
FIG. 2 is a schematic view showing a liquid crystal panel of the liquid crystal display device according to the related art.
Figure 3:
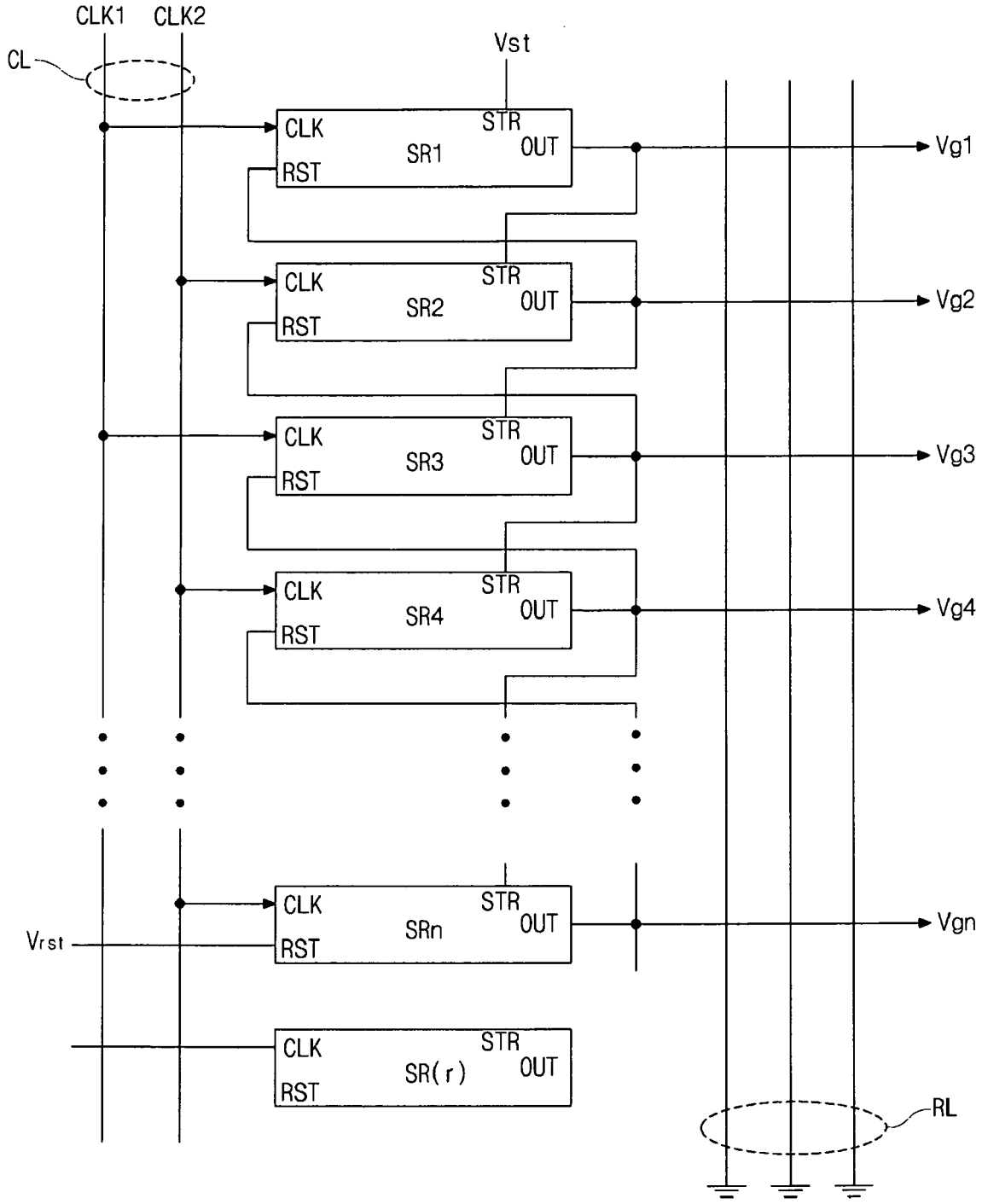
FIG. 3 is a schematic block diagram showing a gate driving unit accordingly to the related art.
Figure 4:
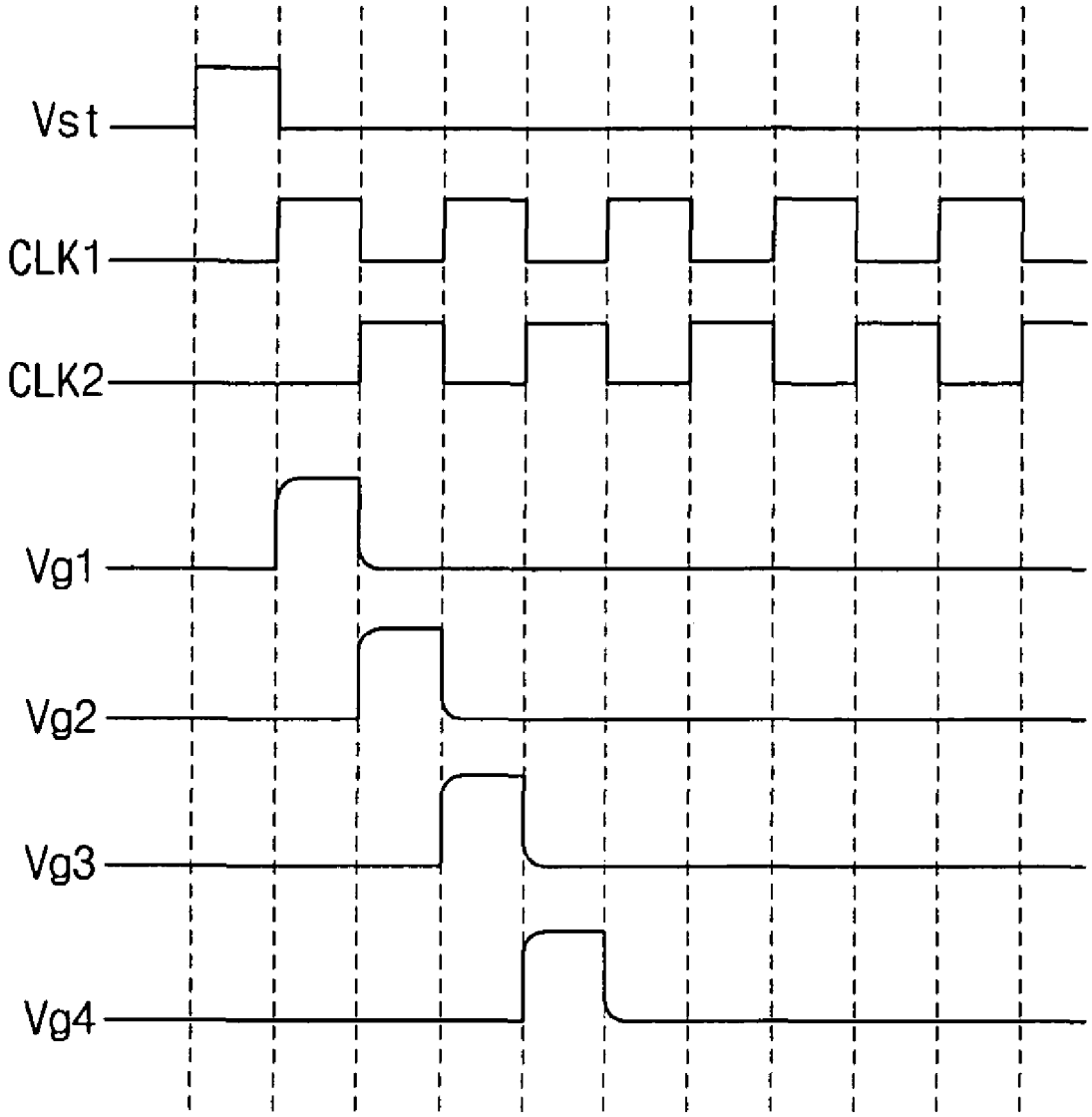
FIG. 4 is a signal timing chart of a scanning signal from a gate driving unit according to the related art.
Figure 5:
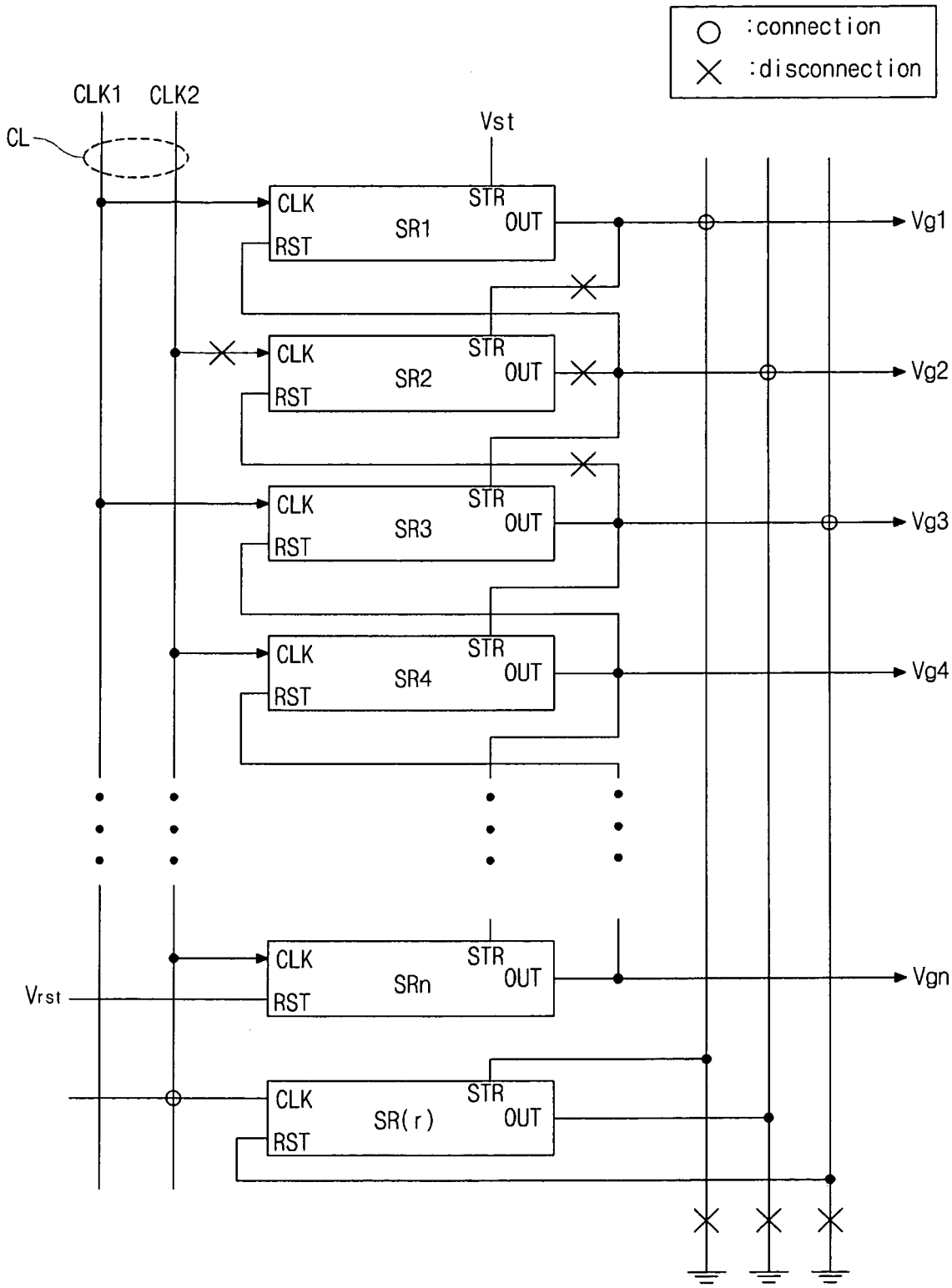
FIG. 5 is a schematic block diagram showing a repairing method of the gate driving unit according to the related art.
Figure 6:
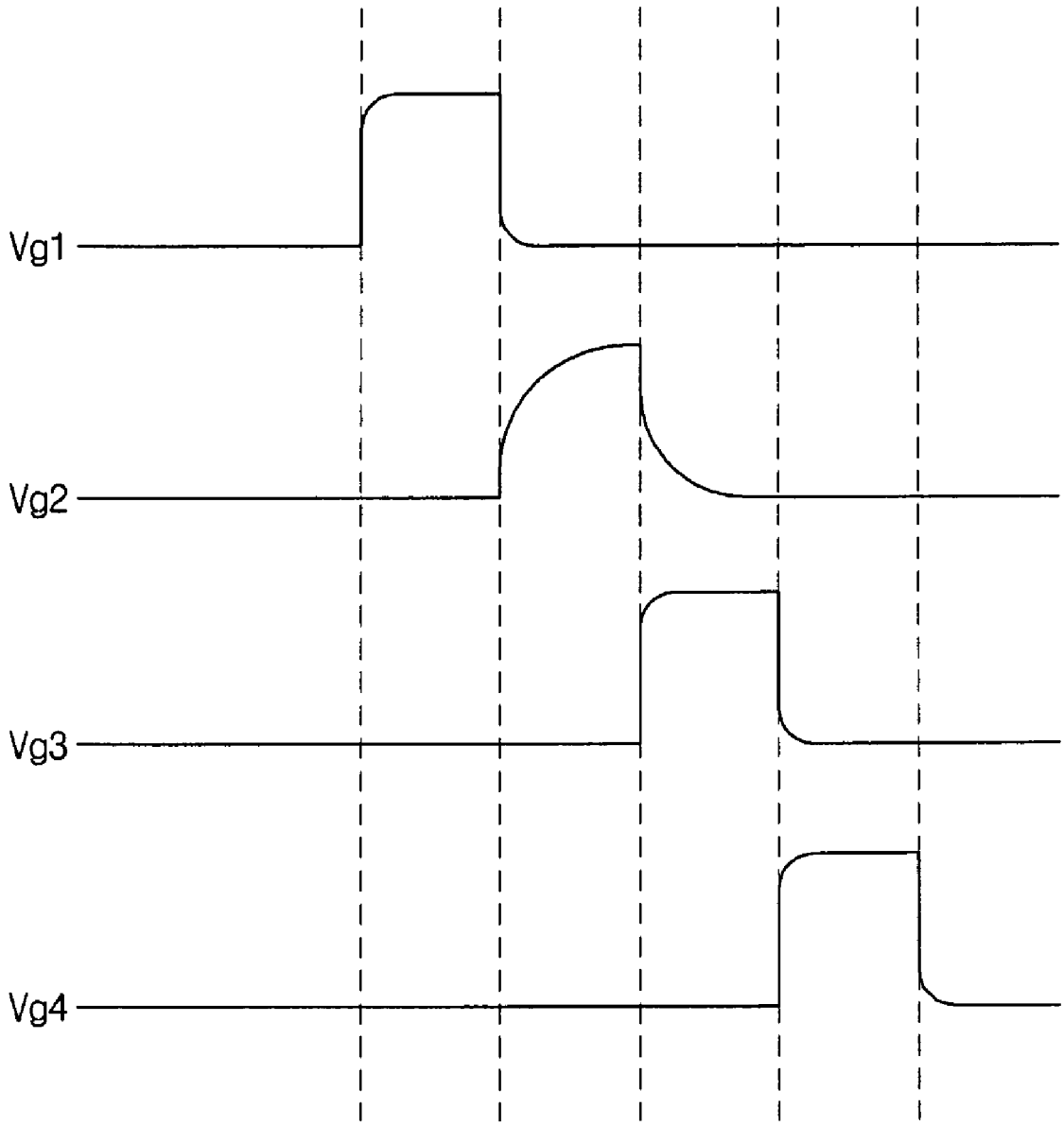
FIG. 6 is a signal timing chart of a scanning signal from a gate driving unit after a repairing process according to the related art.
Figure 7:
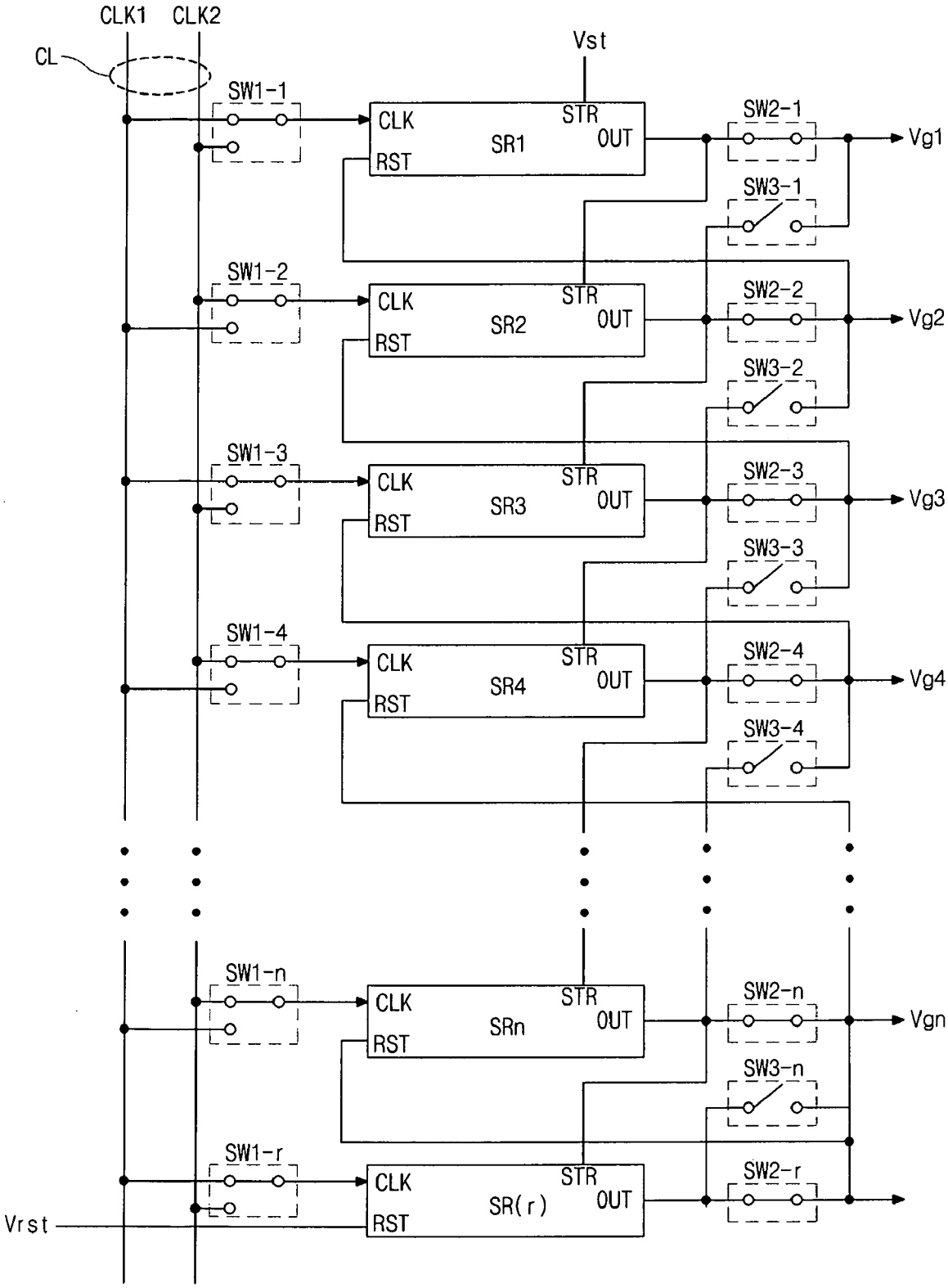
FIG. 7 is a schematic block diagram showing a gate driving unit according to the present invention.

FIG. 7 is a schematic block diagram showing a gate driving unit according to the present invention. The gate driving unit includes first to nth shift registers SR1 to SRn and a redundant repair shift register SR(r), wherein "n" is positive integer. The redundant repair shift register SR(r) is disposed at a position of (n+1)th shift register. The gate driving unit includes a plurality of clock signal lines CL for providing a clock signal terminal CLK in each of the first to nth shift registers SR1 to SRn with first and second clock signals CLK1 and CLK2.

The first to nth shift registers SR1 to SRn output first to nth scanning signals Vg1 to Vgn. The first to nth shift registers SR1 to SRn correspond to first to nth gate lines (not shown) in a liquid crystal panel (not shown) such that the first to nth scanning signals Vg1 to Vgn are input into the first to nth gate lines, respectively. Each of the shift registers SR1 to SRn receives a scanning signal from previous shift register. The scanning signal from the previous shift register is input into a start signal terminal STR of corresponding shift register and functions as a start signal of the corresponding shift register. In addition, each of the shift registers SR1 to SRn receives a scanning signal from next shift register. The scanning signal from the next shift register is input into a reset signal terminal RST of corresponding shift register and functions as a reset signal of the corresponding shift register. For example, the second shift register SR2 receives a first scanning signal Vg1 of the first shift register SR1. The first scanning signal Vg1 functions as a start signal in the second shift register SR2. In addition, the second shift register SR2 receives a third scanning signal Vg3 of the third shift register SR3. The third scanning signal Vg3 functions as a reset signal in the second shift register SR2. In other word, an mth shift register SRm receive a (m−1)th scanning signal Vgm of the (m−1)th shift register Sr(m−1). The (m−1)th scanning signal Vgm functions as a start signal in the mth shift register SRm. In addition, the mth shift register SRm receives a (m+1)th scanning signal Vg(m+1) of the (m+1)th shift register SR(m+1). The (m+1)th scanning signal Vg(m+1) functions as a reset signal in the mth shift register SRm. Here, m is positive integer greater than 1 and equal to or smaller than n. Namely, the first to nth shift registers have a dependent connection relation to each other. The first shift register SR1 receives a start signal Vst from an outer start signal providing member (not shown), and the redundant repair shift register SR(r) receive a reset signal Vrst from an outer reset signal providing member (not shown).

The redundant shift register SR(r) is connected to a last shift register SRn of the first to nth shift registers SR1 to SRn and has the same circuit elements as each of the first to nth shift registers SR1 to SRn. There may be various changes in structural and logical substitutions of each of the first to nth shift registers SR1 to SRn and the redundant shift register SR(r).

The gate driving unit further includes a plurality of switches SW1-1 to SW1-*n*, SW1-*r*, SW2-1 to SW2-*n*, SW2-*r* and SW3-1 to SW3-*n* for controlling input signals into and output signals from the first to nth shift registers SR1 to SRn and the redundant repair shift register SR(r). A plurality of first switches SW1-1 to SW1-*n* and SW1-*r* are connected to the first to nth shift registers SR1 to SRn and the redundant repair shift register SR(r), respectively, such that one of the first and second clock signals CLK1 and CLK2 is applied into corresponding one of the first to nth shift registers SR1 to SRn and the redundant repair shift register SR(r). Namely, each of the first switches SW1-*r* to SW1-*r* connects one of the first and second clock signals CLK1 and CLK2 with a clock signal terminal CLK in each of the first to nth shift registers SR1 to SRn and the redundant repair shift register SR(r). A plurality of second switches SW2-1 to SW2-*n* and SW2-*r* are connected to the first to nth shift registers SR1 to SRn and the redundant repair shift register SR(r), respectively, to control connection between the shift registers SR1 to SRn and SR(r) and corresponding gate lines. When no shift register of the first to nth shift registers is disordered, an output from the redundant shift register SR(r) is not used. Accordingly, the second switch SW2-*r*, which is connected to the redundant shift register SR(r), is not essentially. The second switch SW2-*r* may be omitted. A plurality of third switches SW3-1 to SW3-*n* control connection between a gate line of corresponding shift register and a gate line of previous shift register. Namely, the third switches SW3-1 to SW3-*n* respectively connect the output lines of the second to Nth shift registers and the redundant repair shift register SR(r) with the output lines of the first to Nth shift registers SR1 to SRn.

Each of the switches may include various switch circuits or various switch elements. In the GIP type LCD device, each of the switches is a thin film transistor (TFT) switch. The TFT switch may be simultaneously formed with a switching TFT, which is connected to a liquid crystal capacitor, in a liquid crystal panel. A plurality of gate lines and a plurality of data lines are formed in the liquid crystal panel. Image signals are applied into the data lines, and scanning signals are applied into the gate lines. Moreover, each of the first switches SW1-1 to SW1-*n* and SW1-*r* may include a metaloxide semiconductor (MOS) circuit type switch.

A repairing method of the above gate driving unit for the LCD device is explained with reference to FIG. 8. For convenience of explanation, it is assumed that a second shift register is broken down.

Figure 8:
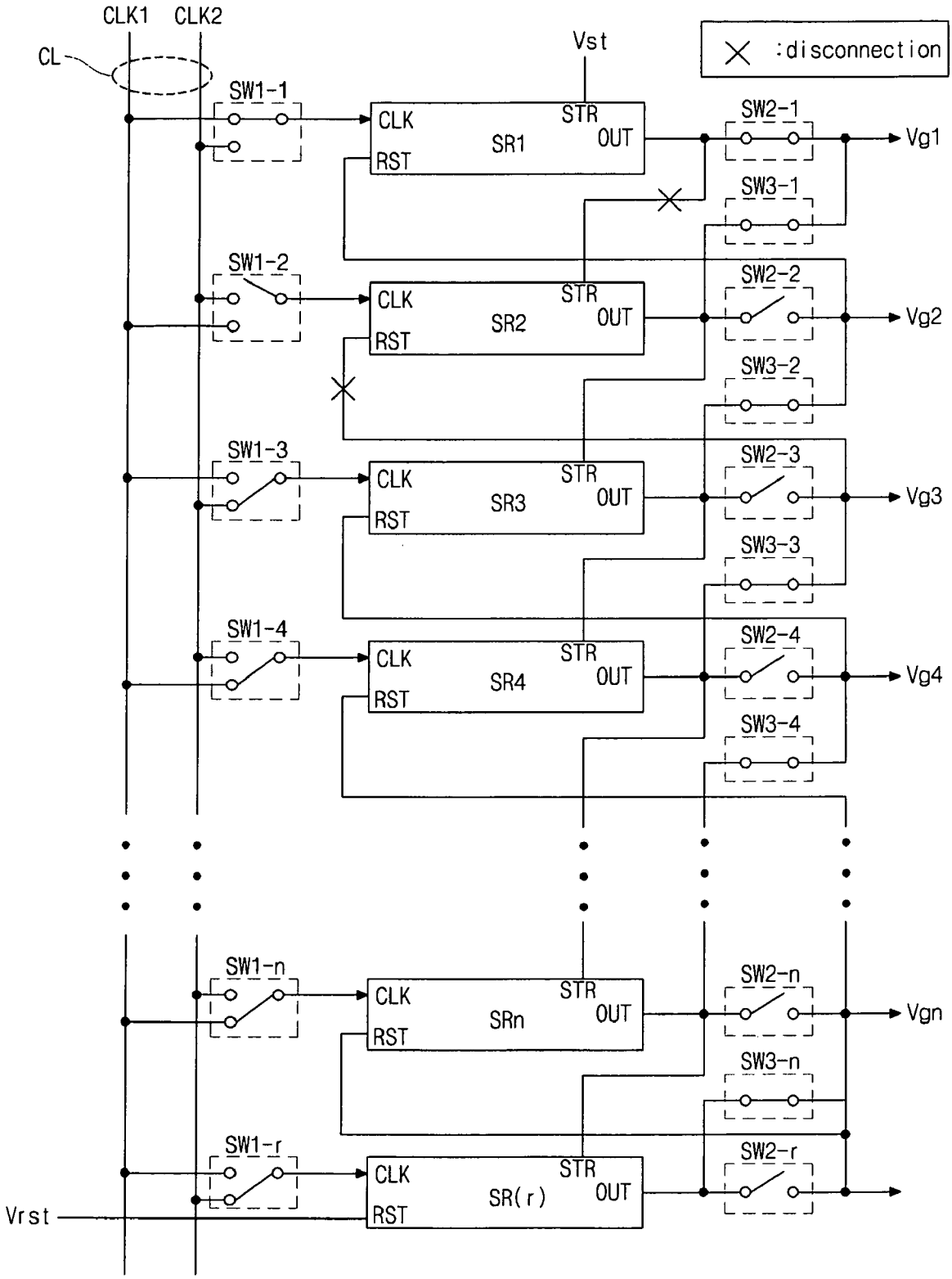
FIG. 8 is a schematic block diagram showing a repairing process of a gate driving unit according to the present invention.

In FIG. 8, input and output lines of a broken-down second shift register SR2 are disconnected. In more detail, a start signal line of the second shift register SR2, which is connected to an output line of the first shift register SR1, and a reset signal line of the second shift register SR2, which is connected to an output line of the third shift register SR3, are cut. For example, a portion of the start signal line of the second shift register SR2 and a portion of the reset signal line of the second shift register SR2 are cut using a laser. The portions are marked as a "X" mark. The first switch SW1-2 of the second shift register SR2 and the second switch SW2-2 of the second shift register SR2 are opened. Accordingly, input signals into the second shift register SR2 and output signals from the second shift register SR2 are completely blocked. Namely, the second shift register SR2 is electrically isolated.

The first switches SW1-3 to SW1-*n* and SW1-*r*, the second switches SW2-3 to SW2-*n* and SW2-*r* and the third switches SW3-1 to SW3-*n* are switched. For example, in the third shift register SR3, the first switch SW1-3, which is initially connected to the first clock signal CLK1, is switched to be connected to the second clock signal CLK2. The second switch SW2-3, which is initially connected to the third gate line (not shown), is switched to be opened. The third switch SW3-3, which is initially opened, is switched to connect the third gate line and the output line of the fourth shift register SR4. In redundant repair shift register SR(r), the first switch SW1-*r*, which is initially connected to the first clock signal CLK1, is switched to be connected to the second clock signal CLK2. The second switch SW2-*r*, which is initially connected to a repair gate line (not shown), is switched to be opened.

Although not shown, a switching control signal line for providing switching signals of each switch and a switching control signal generating unit for generating the switching signals are formed to control the switches.

By the above switching processes, the first shift register SR1 has an initial state. Namely, the first shift register SR1 receives the first clock signal CLK1 and the start signal Vst and outputs the first scanning signal Vg1 into the first gate line (not shown). Since the second shift register SR2 is electrically isolated and the third switch SW3-2 is switched to have a connection state, the second scanning signal Vg2 is provided into the second gate line (not shown) from the third shift register SR3. Similarly, each of the fourth to nth shift register SR4 to SRn and the redundant shift register SR(r) provides a scanning signal into previous gate line. For example, the (n−1)th scanning signal Vg(n−1) is provided into the (n−1)th gate line (not shown) from the nth shift register SRn, and, the nth scanning signal Vgn is provided into the nth gate line (not shown) from the redundant repair shift register SR(r). Namely, an output signal of corresponding shift register next to the broken-down shift register is shifted by one step.

Figure 9:
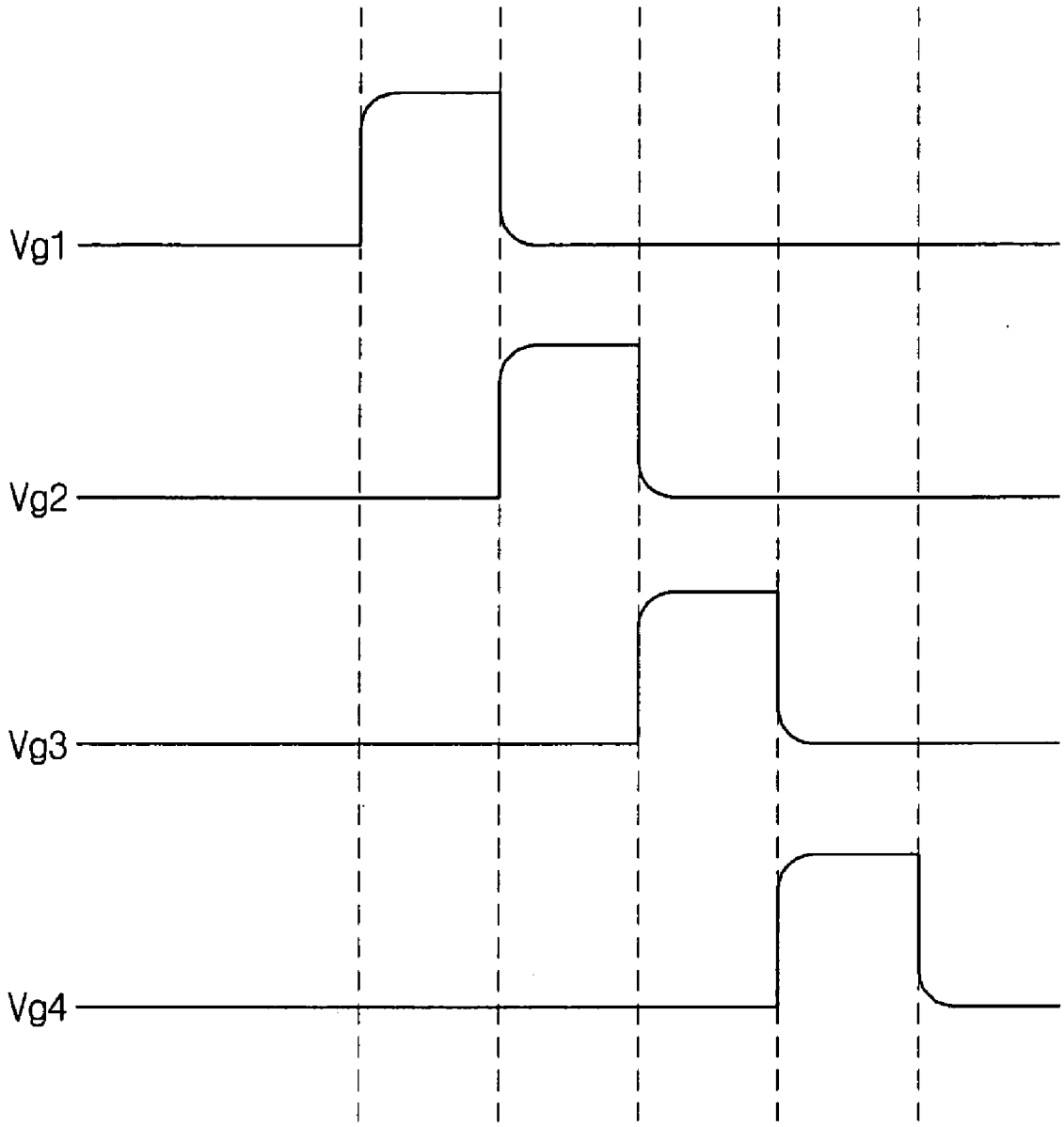
FIG. 9 is a signal timing chart of a scanning signal from a gate driving unit after a repairing process according to the present invention.
Figure 10:
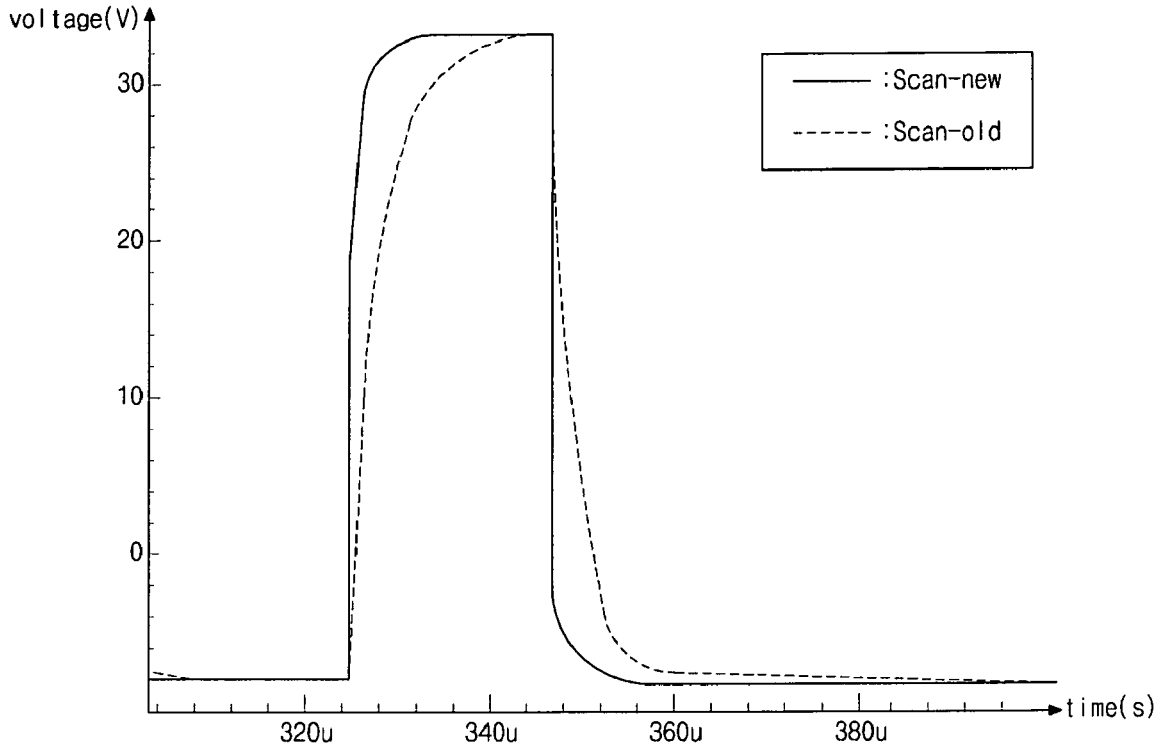
FIG. 10 is a comparison graph of a portion of scanning signal of a repaired gate driving unit according to the related art and a portion of scanning signal of a repaired gate driving unit according to the present invention.

FIG. 9 is a signal timing chart of a scanning signal from a gate driving unit after a repairing process according to the present invention, and FIG. 10 is a comparison graph of a portion of scanning signal of a repaired gate driving unit according to the related art and a portion of scanning signal of a repaired gate driving unit according to the present invention. In FIG. 9, all scanning signals Vg1 to Vg4 have the same shape. Namely, different from the scanning signal "Scan-old" after the related art repairing process, there is no signal distortion in the scanning signal "Scan-new" after a repairing process of the present invention, as shown in FIG. 10.

In the gate driving unit of the present invention, output signals of the shift registers next to the broken-down shift register are shifted by one step. Since a distance of the broken-down shift register and the compensating shift register is relatively closer, there is no signal delay. Particularly, since other the repairing process is performed on the shift register than the broken-down shift register, there is no difference in output signals of adjacent shift registers.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A gate driving unit for a liquid crystal display device including a plurality of liquid crystal pixels, first to Nth gate lines, a plurality of liquid crystal capacitors and a plurality of thin film transistors, comprising:

first and second clock signal lines for providing first and second clock signals;

first to Nth shift registers respectively corresponding to the first to Nth gate lines, the first to Nth shift registers receiving one of the first clock signal and the second clock signal and outputting first to Nth scanning signals, respectively;

a redundant repair shift register as (N+1)th shift register receiving one of first and second clock signals and outputting a repair scanning signal;

a plurality of first switches for respectively connecting one of the first and second clock signal lines to the first to Nth shift registers and the redundant repair shift register;

a plurality of second switches for respectively switching a connection of the first to Nth shift registers with the first to Nth gate lines; and a plurality of third switches for respectively switching a connection of the second to Nth shift registers and the redundant repair shift register with the first to Nth gate lines, wherein N is positive integer, and each of the plurality of first switches is switched between the first and second clock signal lines.

2. The gate driving unit according to claim 1, wherein the redundant repair shift register has the same circuit elements as each of the first to Nth shift register.

3. The gate driving unit according to claim 1, wherein the first to Nth shift registers have a dependent connection relation with each other, and the Nth shift registers register is dependently connected with the redundant repair shift register.

4. The gate driving unit according to claim 3, wherein the second to Nth shift register and the redundant repair shift register receive the first to Nth scanning signals, respectively, to use a start signal and the first to Nth shift register receive the second to Nth scanning signals and the repair scanning signal, respectively, to use a reset signal.

5. The gate driving unit according to claim 1, further comprising a start signal generating unit applying a start signal into the first shift register and a reset signal generating unit applying a reset signal into the redundant repair shift register.

6. The gate driving unit according to claim 1, wherein each of the plurality of first switches is a metaloxide semiconductor (MOS) circuit type switch.

7. The gate driving unit according to claim 1, wherein each of the plurality of second switches and the plurality of third switches is a thin film transistor switch.

8. The gate driving unit according to claim 1, wherein each of the first to Nth shift register, the first, second and third switches is formed at the same substrate as the thin film transistors.

9. A method of repairing a gate driver including first to second clock signal lines for respectively providing first and second clock signals, first to Nth shift registers for respectively providing first to Nth scanning signals into first to Nth gate lines, an (N+1)th shift register as a redundant shift register for repairing an disordered shift register and providing a redundant repair signal into a redundant repair gate line, first switches for respectively connecting one of the first and second clock signal lines with clock signal terminals of the first to (N+1)th shift registers, second switches for respectively connecting output lines of the first to Nth shift registers with the first to Nth gate lines, third switches for respectively connecting the output lines of the second to (N+1)th shift registers with the first to Nth gate lines, a start signal line connecting a start signal terminal of the second to (N+1)th shift registers with the output line of the first to Nth shift registers, and a reset signal line connecting a reset signal terminal of the first to Nth shift registers with the output line of the second to (N+1)th shift registers, comprising:

detecting a disorder of an Mth shift register;

switching off the first switch of the Mth shift register to block an input clock signal into the Mth shift register;

disconnecting the start signal line and the reset signal line of the Mth shift register;

switching off the second switch of each of the Mth to Nth shift registers to block output signals from the Mth to Nth shift registers into the Mth to Nth gate lines;

switching the first switch of each of (M+1)th to (N+1)th shift registers to change the first clock signal applied into corresponding shift registers into the second clock signal and the second clock signal applied into corresponding shift registers into the first clock signal; and switching on the third switch of each of Mth to Nth shift registers to provide output signals of the (M+1)th to (N+1)th shift registers into Mth to Nth gate lines, respectively, wherein each of N and M is positive integer, and M is greater than 1, and wherein M is equal to or smaller than N.

10. The method according to claim 9, wherein the first shift register receives a start signal from a start signal generating unit and the (N+1)th shift register receives a reset signal from a reset signal generating unit.

* * * * *